US010233399B2

(12) United States Patent
Koseoglu et al.

(10) Patent No.: US 10,233,399 B2
(45) Date of Patent: Mar. 19, 2019

(54) SELECTIVE MIDDLE DISTILLATE HYDROTREATING PROCESS

(71) Applicant: Saudi Arabian Oil Company, Dhahran (SA)

(72) Inventors: Omer Refa Koseoglu, Dhahran (SA); Abdulrahman Al-Bassam, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 23 days.

(21) Appl. No.: 15/402,884

(22) Filed: Jan. 10, 2017

(65) Prior Publication Data

US 2017/0211002 A1 Jul. 27, 2017

Related U.S. Application Data

(62) Division of application No. 13/558,584, filed on Jul. 26, 2012, now abandoned.

(Continued)

(51) Int. Cl.
*C10G 65/16* (2006.01)
*C10G 67/04* (2006.01)

(Continued)

(52) U.S. Cl.
CPC ..... *C10G 65/16* (2013.01); *C10G 21/00* (2013.01); *C10G 45/08* (2013.01); *C10G 45/44* (2013.01);

(Continued)

(58) Field of Classification Search
CPC ..... C10G 21/00; C10G 2300/1096; C10G 2300/202; C10G 2300/301;

(Continued)

(56) References Cited

U.S. PATENT DOCUMENTS 2,114,852 A 4/1938 McKittrick
2,634,230 A 4/1953 Arnolt (Continued)

FOREIGN PATENT DOCUMENTS

JP 2000256675 A 9/2000

OTHER PUBLICATIONS

Don W. Green et al., "Perry's Chemical Engineers Handbook", 8th Ed., 2008, McGraw-Hil, p. 15-6.

(Continued)

*Primary Examiner* — Renee Robinson
*Assistant Examiner* — Derek N Mueller
(74) *Attorney, Agent, or Firm* — Abelman, Frayne & Schwab

(57) ABSTRACT

A selective mid-distillate hydrotreating process is provided for production of hydrocarbon fuels with an ultra-low level of sulfur in which the initial hydrocarbon feedstock is introduced into to an aromatic extraction zone to produce an aromatic-lean fraction and an aromatic-rich fraction, which contain different classes of organosulfur compounds having different reactivities when subjected to hydrotreating reactions. The aromatic-lean fraction contains primarily labile heteroatom-containing compounds, and is passed to a first hydrotreating zone operating under mild conditions to remove the sulfur heteroatom from organosulfur hydrocarbon compounds. The aromatic-rich fraction contains primarily refractory heteroatom-containing compounds, including aromatic molecules such as certain benzothiophenes (e.g., long chain alkylated benzothiophenes), dibenzothiophene and alkyl derivatives, such as sterically hindered 4,6-dimethyldibenzothiophene, and is passed to a hydrotreating zone operating under relatively severe conditions to remove the heteroatom from sterically hindered refractory compounds.

30 Claims, 9 Drawing Sheets

Related U.S. Application Data

(60) Provisional application No. 61/513,009, filed on Jul. 29, 2011.

(51) Int. Cl.

| | |
|---|---|
| ***C10G 45/08*** | (2006.01) |
| ***C10G 45/44*** | (2006.01) |
| ***C10G 45/52*** | (2006.01) |
| ***C10G 67/00*** | (2006.01) |
| ***C10G 21/00*** | (2006.01) |

(52) U.S. Cl.

CPC ..... *C10G 45/52* (2013.01); *C10G 67/00* (2013.01); *C10G 67/04* (2013.01); *C10G 67/0418* (2013.01); *C10G 67/0436* (2013.01); *C10G 2300/1037* (2013.01); *C10G 2300/1096* (2013.01); *C10G 2300/202* (2013.01); *C10G 2300/301* (2013.01); *C10G 2300/4018* (2013.01); *C10G 2300/44* (2013.01)

(58) Field of Classification Search

CPC ..... C10G 2300/4018; C10G 2300/44; C10G 45/08; C10G 45/44; C10G 45/52; C10G 65/16; C10G 67/00; C10G 67/04; C10G 67/0418; C10G 67/0436

See application file for complete search history.

(56) References Cited

U.S. PATENT DOCUMENTS

| | | | |
|---|---|---|---|
| 3,001,932 | A | 9/1961 | Brooke |
| 3,052,620 | A | 9/1962 | Hanson |
| 3,175,970 | A | 3/1965 | Bercik et al. |
| 3,267,020 | A | 8/1966 | Wilson et al. |
| 3,328,290 | A | 6/1967 | Hengstebeck |
| 3,505,210 | A | 4/1970 | Wallace et al. |
| 3,537,981 | A | 11/1970 | Parker |
| 3,816,301 | A | 6/1974 | Sorgenti |
| 4,013,549 | A | 3/1977 | Bushnell |
| 4,639,308 | A | 1/1987 | Lee |
| 4,851,109 | A | 7/1989 | Chen et al. |
| 4,990,242 | A | 2/1991 | Louie et al. |
| 5,360,532 | A | 11/1994 | Fletcher et al. |
| 5,387,523 | A | 2/1995 | Monticello |
| 5,409,599 | A | 4/1995 | Harandi |
| 5,582,714 | A | 12/1996 | Forte |
| 5,718,820 | A | 2/1998 | Morel et al. |
| 5,753,102 | A | 5/1998 | Funakoshi et al. |
| 6,103,105 | A | 8/2000 | Cooper et al. |
| 6,113,775 | A | 9/2000 | Christolini et al. |
| 6,171,478 | B1 | 1/2001 | Cabrera et al. |
| 6,235,190 | B1 | 5/2001 | Bertram |
| 6,261,441 | B1 | 7/2001 | Gentry et al. |
| 6,277,271 | B1 | 8/2001 | Kocal |
| 6,328,879 | B1 | 12/2001 | Kalnes |
| 6,358,402 | B1 | 3/2002 | Schucker |
| 6,551,502 | B1 | 4/2003 | Lee et al. |
| 6,623,627 | B1 | 9/2003 | Zhou |
| 6,638,419 | B1 | 10/2003 | Da Silva et al. |
| 6,676,829 | B1 | 1/2004 | Angevine et al. |
| 6,726,835 | B2 | 4/2004 | Towler et al. |
| 6,821,412 | B1 | 11/2004 | Fujukawa et al. |
| 6,824,673 | B1 | 11/2004 | Ellis et al. |
| 6,866,772 | B2 | 3/2005 | Selai et al. |
| 6,929,738 | B1 | 8/2005 | Riley et al. |
| 7,238,274 | B2 | 7/2007 | Turner |
| 7,238,275 | B2 | 7/2007 | Stupin et al. |
| 7,244,350 | B2 | 7/2007 | Martin et al. |
| 7,270,737 | B2 | 9/2007 | Picard et al. |
| 7,276,150 | B2 | 10/2007 | Nagamatsu et al. |
| 7,374,666 | B2 | 5/2008 | Wachs |
| 7,384,540 | B2 | 6/2008 | Galeazzi |
| 2002/0029997 | A1 | 3/2002 | Rappas et al. |
| 2003/0070965 | A1 | 4/2003 | Shih et al. |
| 2004/0035752 | A1 | 2/2004 | Marcharl-George et al. |
| 2005/0092654 | A1 | 5/2005 | Ellis et al. |
| 2005/0133411 | A1 | 6/2005 | Zeuthen et al. |
| 2006/0000751 | A1 | 1/2006 | Bouchy et al. |
| 2006/0180501 | A1 | 8/2006 | Da Silva et al. |
| 2007/0007177 | A1 | 1/2007 | Hunter et al. |
| 2007/0261993 | A1 | 11/2007 | Nicolaos et al. |
| 2007/0289899 | A1 | 12/2007 | Kelly et al. |
| 2008/0011645 | A1 | 1/2008 | Dean |
| 2009/0107890 | A1 | 4/2009 | Hamad et al. |

OTHER PUBLICATIONS

Parkash, S., "Refining Processes Handbook", Gulf Publishing, 2003, pp. 29-34.

SELECTIVE MIDDLE DISTILLATE HYDROTREATING PROCESS

RELATED APPLICATIONS

This application is a divisional application of U.S. patent application Ser. No. 13/558,584, which claims priority to U.S. Provisional Patent Application No. 61/513,009 filed Jul. 29, 2011, the disclosures of which are hereby incorporated by reference.

BACKGROUND OF THE INVENTION

Field of the Invention

The present invention relates to hydrotreating processes to efficiently reduce the sulfur content of hydrocarbons.

Description of Related Art

The discharge into the atmosphere of sulfur compounds during processing and end-use of the petroleum products derived from sulfur-containing sour crude oil poses health and environmental problems. Stringent reduced-sulfur specifications applicable to transportation and other fuel products have impacted the refining industry, and it is necessary for refiners to make capital investments to greatly reduce the sulfur content in gas oils to 10 parts per million by weight (ppmw) or less. In the industrialized nations such as the United States, Japan and the countries of the European Union, refineries have already been required to produce environmentally clean transportation fuels. For instance, in 2007 the United States Environmental Protection Agency required the sulfur content of highway diesel fuel to be reduced 97%, from 500 ppmw (low sulfur diesel) to 15 ppmw (ultra-low sulfur diesel). The European Union has enacted even more stringent standards, requiring diesel and gasoline fuels sold in 2009 to contain less than 10 ppmw of sulfur. Other countries are following in the footsteps of the United States and the European Union and are moving forward with regulations that will require refineries to produce transportation fuels with ultra-low sulfur levels.

To keep pace with recent trends toward production of ultra-low sulfur fuels, refiners must choose among the processes or crude oils that provide flexibility that ensures future specifications are met with minimum additional capital investment, in many instances by utilizing existing equipment. Conventional technologies such as hydrocracking and two-stage hydrotreating offer solutions to refiners for the production of clean transportation fuels. These technologies are available and can be applied as new grassroots production facilities are constructed. However, many existing hydroprocessing facilities, such as those using relatively low pressure hydrotreaters, represent a substantial prior investment and were constructed before these more stringent sulfur reduction requirements were enacted. It is very difficult to upgrade existing hydrotreating reactors in these facilities because of the comparatively more severe operational requirements (i.e., higher temperature and pressure) to obtain clean fuel production. Available retrofitting options for refiners include elevation of the hydrogen partial pressure by increasing the recycle gas quality, utilization of more active catalyst compositions, installation of improved reactor components to enhance liquid-solid contact, the increase of reactor volume, and the increase of the feedstock quality.

There are many hydrotreating units installed worldwide producing transportation fuels containing 500-3000 ppmw sulfur. These units were designed for, and are being operated at, relatively mild conditions (i.e., low hydrogen partial pressures of 30 kilograms per square centimeter for straight run gas oils boiling in the range of 180° C. to 370° C.).

With the increasing prevalence of more stringent environmental sulfur specifications in transportation fuels mentioned above, the maximum allowable sulfur levels are being reduced to no greater than 15 ppmw, and in some cases no greater than 10 ppmw. This ultra-low level of sulfur in the end product typically requires either construction of new high pressure hydrotreating units, or a substantial retrofitting of existing facilities, e.g., by incorporating gas purification systems, reengineering the internal configuration and components of reactors, and/or deployment of more active catalyst compositions.

Sulfur-containing compounds that are typically present in hydrocarbon fuels include aliphatic molecules such as sulfides, disulfides and mercaptans as well as aromatic molecules such as thiophene, benzothiophene and its long chain alkylated derivatives, and dibenzothiophene and its alkyl derivatives such as 4,6-dimethyl-dibenzothiophene.

Aliphatic sulfur-containing compounds are more easily desulfurized (labile) using mild hydrodesulfurization methods. However, certain highly branched aromatic molecules can sterically hinder the sulfur atom removal and are moderately more difficult to desulfurize (refractory) using mild hydrodesulfurization methods.

Among the sulfur-containing aromatic compounds, thiophenes and benzothiophenes are relatively easy to hydrodesulfurize. The addition of alkyl groups to the ring compounds increases the difficulty of hydrodesulfurization. Dibenzothiophenes resulting from addition of another ring to the benzothiophene family are even more difficult to desulfurize, and the difficulty varies greatly according to their alkyl substitution, with di-beta substitution being the most difficult to desulfurize, thus justifying their "refractory" appellation. These beta substituents hinder exposure of the heteroatom to the active site on the catalyst.

The economical removal of refractory sulfur-containing compounds is therefore exceedingly difficult to achieve, and accordingly removal of sulfur-containing compounds in hydrocarbon fuels to an ultra-low sulfur level is very costly by current hydrotreating techniques. When previous regulations permitted sulfur levels up to 500 ppmw, there was little need or incentive to desulfurize beyond the capabilities of conventional hydrodesulfurization, and hence the refractory sulfur-containing compounds were not targeted. However, in order to meet the more stringent sulfur specifications, these refractory sulfur-containing compounds must be substantially removed from hydrocarbon fuels streams.

The relative reactivity of thiols and sulfides are much higher than those of aromatic sulfur compounds, as indicated in a study published in Song, Chunshan, "An overview of new approaches to deep desulfurization for ultra-clean gasoline, diesel fuel and jet fuel" *Catalysis Today,* 86 (2003), pp. 211-263. Mercaptans/thiols and sulfides are much more reactive than the aromatic sulfur compounds. Relative reaction rates of certain sulfur compounds are plotted as a function of molecule size and difficulty of hydrodesulfurization in FIG. 1.

Aromatic extraction is an established process used at certain stages of various refinery and other petroleum-related operations. In certain existing processes, it is desirable to remove aromatics from the end product, e.g., lube oils and certain fuels, e.g., diesel fuel. In other processes, aromatics are extracted to produce aromatic-rich products, for instance, for use in various chemical processes and as an octane booster for gasoline.

With the steady increase in demand for hydrocarbon fuels having an ultra-low sulfur level, a need exists for an efficient and effective process and apparatus for desulfurization.

Accordingly, it is an object of the present invention to desulfurize a hydrocarbon fuel stream containing different classes of sulfur-containing compounds having different reactivities.

SUMMARY OF THE INVENTION

In accordance with one or more embodiments, the invention relates to a system and method of hydrotreating hydrocarbon feedstocks to efficiently reduce the sulfur content.

In accordance with one or more embodiments, a method of processing a hydrocarbon feed to reduce the concentration of undesired organosulfur compounds is provided. The method comprises:

a. separating the hydrocarbon feed into an aromatic-lean fraction that contains labile heteroatom-containing compounds and an aromatic-rich fraction that contains refractory heteroatom-containing compounds;

b. subjecting the aromatic-lean fraction to a first hydrotreating zone operating at mild hydrotreating conditions effective for reducing the content of heteroatom-containing compounds in the aromatic-lean fraction and recovering a first hydrotreated effluent; and c. subjecting the aromatic-rich fraction to a second hydrotreating zone operating at conditions effective for reducing the content of heteroatom-containing compounds in the aromatic-rich fraction and producing a second hydrotreated effluent.

In accordance with one or more additional embodiments, a method of processing a hydrocarbon feed further includes subjecting hydrotreated liquid effluent from the second hydrotreating zone to an aromatic hydrogenation zone, thereby recovering a hydrogenated hydrocarbon product stream.

As used herein, the term "labile compounds" when describing heteroatom-containing compounds such as organosulfur and organonitrogen compounds that can be easily treated to remove the heteroatom, i.e., desulfurized or denitrogenized, under relatively mild hydrodesulfurization pressure and temperature conditions, and the term "refractory compounds" when describing heteroatom-containing compounds such as organosulfur and organonitrogen compounds that are relatively more difficult to be treated, i.e., desulfurized or denitrogenized, under mild hydrodesulfurization conditions.

Additionally, as used herein, the terms "mild hydrotreating," "mild operating conditions" and "mild conditions" (when used in reference to hydrotreating) mean hydrotreating processes operating at temperatures of 400° C. and below, hydrogen partial pressures of 40 bars and below, and hydrogen feed rates of 500 liters per liter of oil and below.

The terms "severe hydrotreating," "severe operating conditions" and "severe conditions" (when used in reference to hydrotreating) mean hydrotreating processes operating at temperatures of 320° C. and above, hydrogen partial pressures of 40 bars and above, and hydrogen feed rates of 300 liters per liter of oil and above.

Since aromatic extraction operations typically do not provide sharp cut-offs between the aromatics and non-aromatics, the aromatic-lean fraction contains a major proportion of the non-aromatic content of the initial feed and a minor proportion of the aromatic content of the initial feed (e.g., a certain portion of the thiophene in the initial feed and short chain alkyl derivatives), and the aromatic-rich fraction contains a major proportion of the aromatic content of the initial feed and a minor proportion of the non-aromatic content of the initial feed. The amount of non-aromatics in the aromatic-rich fraction, and the amount of aromatics in the aromatic-lean fraction, depend on various factors as will be apparent to one of ordinary skill in the art, including the type of extraction, the number of theoretical plates in the extractor, the type of solvent and the solvent ratio.

The feed portion that is passed to the aromatic-rich fraction includes aromatic compounds that contain heteroatoms and those that are free of heteroatoms. Heteroatom-containing aromatic compounds include aromatic sulfur-containing compounds such as thiophene compounds and derivatives including long chain alkylated derivatives, benzothiophene compounds and derivatives including alkylated derivatives thereof, dibenzothiophene compounds and derivatives including alkyl derivatives such as sterically hindered 4,6-dimethyl-dibenzothiophene, and benzonaphtenothiophene compounds and derivatives including alkyl derivatives. In addition heteroatom-containing aromatic compounds include aromatic nitrogen-containing compounds such as pyrrole, quinoline, acridine, carbazoles and their derivatives. These nitrogen- and sulfur-containing aromatic compounds are targeted in the aromatic separation step(s) generally by their solubility in the extraction solvent. Various non-aromatic sulfur-containing compounds that may have been present in the initial feed, i.e., prior to hydrotreating, include mercaptans, sulfides and disulfides. Depending on the aromatic extraction operation type and/or condition, a preferably very minor portion of non-aromatic nitrogen- and sulfur-containing compounds can pass to the aromatic-rich fraction.

As used herein, the term "major proportion of the non-aromatic compounds" means at least greater than 50 weight % (W %) of the non-aromatic content of the feed to the extraction zone, in certain embodiments at least greater than about 85 W %, and in further embodiments greater than at least about 95 W %. Also as used herein, the term "minor proportion of the non-aromatic compounds" means no more than 50 W % of the non-aromatic content of the feed to the extraction zone, in certain embodiments no more than about 15 W %, and in further embodiments no more than about 5 W %.

Also as used herein, the term "major proportion of the aromatic compounds" means at least greater than 50 W % of the aromatic content of the feed to the extraction zone, in certain embodiments at least greater than about 85 W %, and in further embodiments greater than at least about 95 W %. Also as used herein, the term "minor proportion of the aromatic compounds" means no more than 50 W % of the aromatic content of the feed to the extraction zone, in certain embodiments no more than about 15 W %, and in further embodiments no more than about 5 W %.

Still other aspects, embodiments, and advantages of these exemplary aspects and embodiment, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

The foregoing summary as well as the following detailed description will be best understood when read in conjunction with the attached drawings. For the purpose of illustrating the invention, there are shown in the drawings embodiments which are presently preferred. It should be understood, however, that the invention is not limited to the precise arrangements and apparatus shown. In the drawings the same or similar numeral is used to refer to the same or similar elements, in which.

DETAILED DESCRIPTION OF THE INVENTION

A selective mid distillate hydrotreating process is described for production of hydrocarbon fuels with an ultra-low level of heteroatomic compounds including organosulfur and organonitrogen compounds which includes the following steps:

a. subjecting the initial hydrocarbon feedstock to an aromatic extraction zone to provide an aromatic-lean fraction and an aromatic-rich fraction, which fractions contain different classes of heteroatom-containing compounds having different reactivities when subjected to hydrotreating reactions;

b. passing the aromatic-lean fraction containing primarily labile compounds, including aliphatic molecules such as sulfides, disulfides and mercaptans, to a first hydrotreating zone operating under mild conditions to remove the heteroatom(s) from such labile compounds including to remove sulfur from the organosulfur compounds; and c. passing the aromatic-rich fraction containing primarily refractory compounds, including aromatic molecules such as certain benzothiophenes (e.g., long chain alkylated benzothiophenes), dibenzothiophene and alkyl derivatives such as sterically hindered 4,6-dimethyldibenzothiophene, to a second hydrotreating zone operating under relatively severe conditions to remove the heteroatom(s) from such refractory compounds including to remove sulfur from sterically hindered refractory organosulfur compounds.

Figure 1:
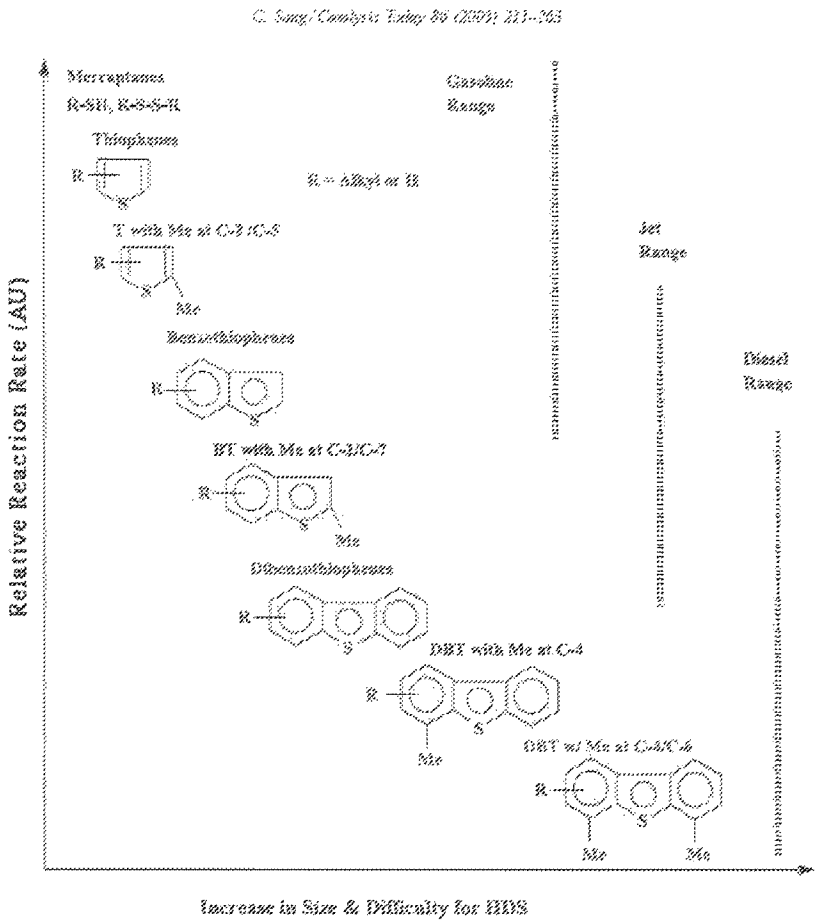
FIG. 1 PRIOR ART
FIG. 1 is a graphic representation of the relative decrease in reactivities of various compounds in the hydrodesulfurization process with the increase in size of the sulfur-containing molecule.
Figure 2:
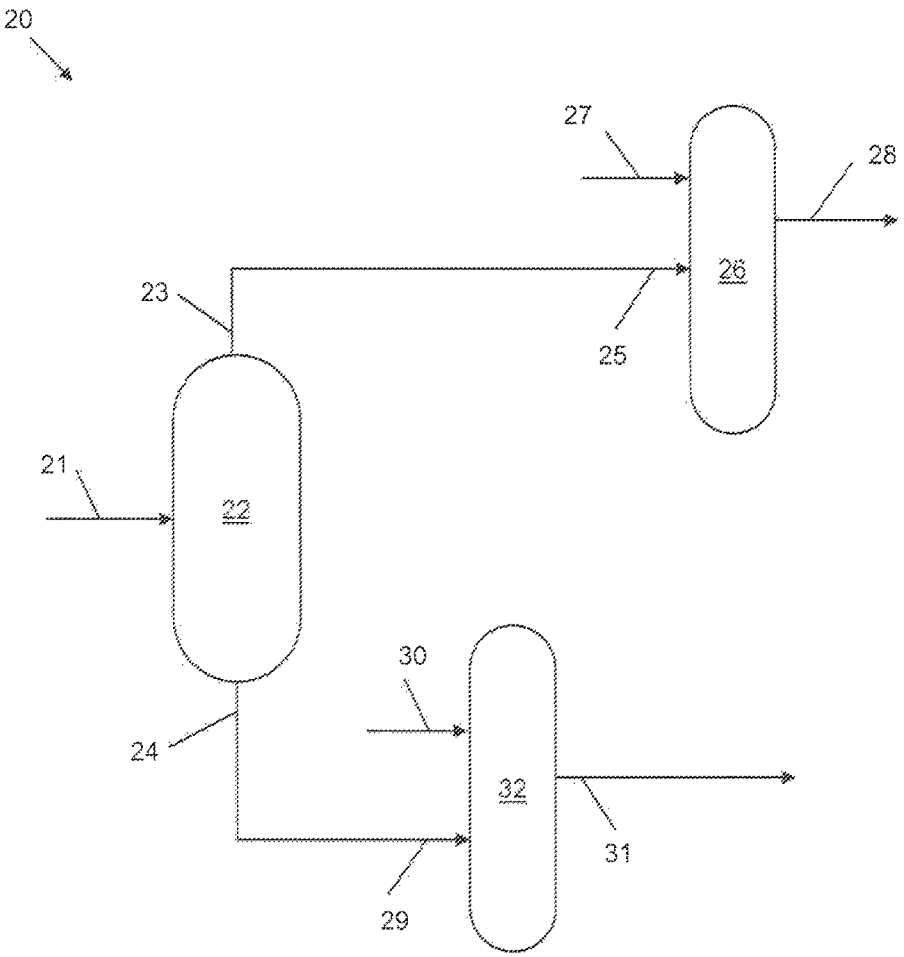
FIG. 2 is a schematic diagram of a selective hydrotreating system and process.

Referring to FIG. 2, a selective hydrotreating apparatus 20 is schematically illustrated. Apparatus 20 includes an aromatic separation zone 22, a first hydrotreating zone 26 and a second hydrotreating zone 32. Aromatic separation zone 22 includes a feed inlet 21, an aromatic-lean outlet 23 and an aromatic-rich outlet 24. Various embodiments of aromatic separation zone 22 are described in conjunction with FIGS. 4-10.

First hydrotreating zone 26 includes an inlet 25 in fluid communication with aromatic-lean outlet 23, a hydrogen gas inlet 27 and a first hydrotreated effluent outlet 28. Second hydrotreating zone 32 includes an inlet 29 in fluid communication with aromatic-rich outlet 24, a hydrogen gas inlet 30 and a second hydrotreated effluent outlet 31.

A hydrocarbon stream is introduced via inlet 21 of the aromatic separation zone 22 to be separated into an aromatic-lean stream discharged via the aromatic-lean outlet 23 and an aromatic-rich stream discharged from the aromatic-rich outlet 24.

The aromatic-lean fraction contains a major proportion of the non-aromatic content of the initial feed and contains labile organosulfur and organonitrogen compounds, and a minor proportion of the aromatic content of the initial feed. The aromatic-lean fraction is passed to inlet 25 of the first hydrotreating zone 26 and into contact with a hydrodesulfurization catalyst and an effective quantity of hydrogen via inlet 27. Since sterically hindered sulfur-containing compounds are generally present in relatively low concentrations, if at all, in the aromatic-lean stream to be desulfurized, first hydrotreating zone 26 is operated under mild conditions.

The aromatic-rich fraction from the aromatic extraction zone 22 generally includes a major proportion of the aromatic content of the initial feedstock and a minor proportion of the non-aromatic content of the initial feedstock. The aromatic-rich fraction is conveyed to inlet 29 of the second hydrotreating zone 32 and into contact with a hydrodesulfurization catalyst and an effective quantity of hydrogen via inlet 30. The second hydrotreating zone 32 is operated under conditions effective to remove sulfur and other heteroatoms as required to meet product specifications. These operating conditions are generally more severe than the operating conditions that are effective in the first hydrotreating zone 26, for instance, tailored for removal of the heteroatom(s) from such refractory compounds including removal of sulfur from sterically hindered refractory organosulfur compounds.

The resulting hydrocarbon streams via outlet 28 and outlet 31 contain a reduced level of heteroatom-containing compounds. For instance, in certain embodiments organosulfur compounds can be reduced to an ultra-low level, i.e., less than 15 ppmw or even 10 ppmw, since substantially all of the aliphatic organosulfur compounds and thiophenes are labile under mild hydrotreating conditions, and the sulfur in the refractory aromatic organosulfur compounds such as sterically hindered multi-ring compounds that were present in the initial feed are removed under the severe hydrotreating conditions.

Figure 3:
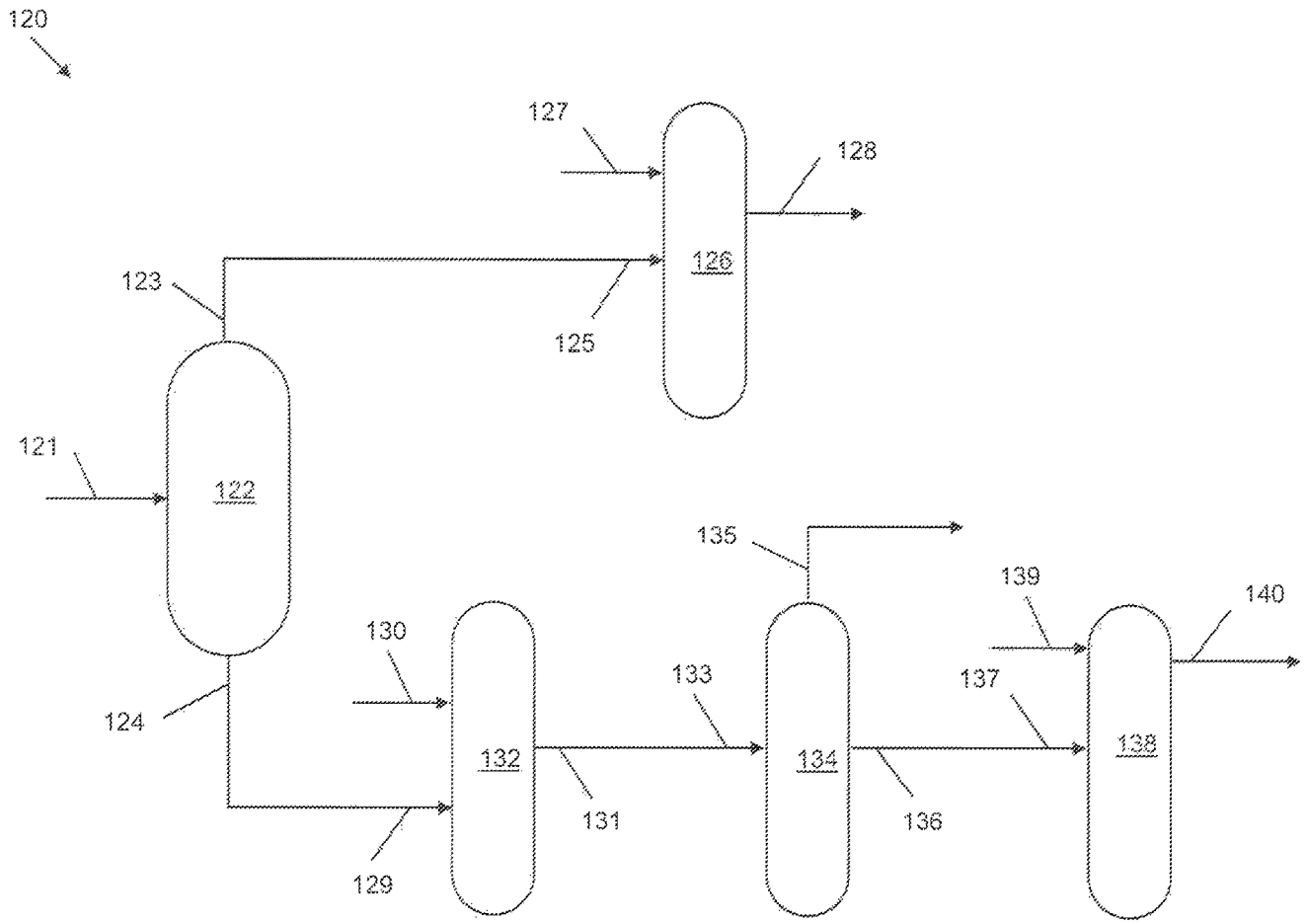
FIG. 3 is a schematic diagram of another embodiment of a selective mid-distillate hydrotreating system and process including a hydrogenation zone.

Referring to FIG. 3, a selective hydrotreating apparatus 120 according to another embodiment is schematically illustrated. Apparatus 120 includes an aromatic separation zone 122, a first hydrotreating zone 126, a second hydrotreating zone 132, a flashing unit 134 and an aromatic hydrogenation zone 138. Aromatic separation zone 122 includes a feed inlet 121, an aromatic-lean outlet 123 and an aromatic-rich outlet 124. Various embodiments of unit-operations contained within aromatic separation zone 122 are detailed further herein in conjunction with FIGS. 4-10.

First hydrotreating zone 126 includes an inlet 125 in fluid communication with aromatic-lean outlet 123, a hydrogen gas inlet 127 and a first hydrotreated effluent outlet 128. Second hydrotreating zone 132 includes an inlet 129 in fluid communication with aromatic-rich outlet 124, a hydrogen gas inlet 130 and a second hydrotreated effluent outlet 131. Flashing unit 134 includes an inlet 133 in fluid communication with second hydrotreated effluent outlet 131, a vapor outlet 135 and a liquid outlet 136. Hydrogenation reaction zone 138 includes an inlet 137 in fluid communication with liquid outlet 136, a hydrogen gas inlet 139 and a hydrogenated product outlet 140.

The process operates similar to that described with respect to FIG. 2, and the hydrodesulfurized effluent from outlet 131 is passed to inlet 133 of the flashing unit 134 to remove lighter gases, such as $H_2S$, $NH_3$, methane, ethane, propane, butanes and naphtha boiling in the range of 36° C.-180° C., and these lighter gases are discharged via outlet 135. The liquid effluent from outlet 136 is conveyed to inlet 137 of the aromatic hydrogenation zone 138 for hydrogenation of the aromatic compounds, for instance, to increase the cetane number, reduce the product density, and reduce the content of poly nuclear aromatics. The hydrogenated effluent, containing a reduced level of organosulfur compounds and a relatively high cetane number, is discharged via outlet 140.

The addition of an aromatic separation zone into the selective hydrotreating apparatus and processes described herein integrates relatively low cost units as well as more favorable operating conditions in the mild hydrodesulfurization zone, i.e., milder pressure and temperature and reduced hydrogen consumption. Only the aromatic-rich fraction is subjected to the relatively more severe conditions in the second hydrotreating zone to convert the refractory aromatic sulfur-containing compounds. This results in more cost-effective desulfurization of hydrocarbon fuels, including for removal of the sterically hindered refractory sulfur-containing compounds, thereby efficiently and economically achieving ultra-low sulfur content fuel products.

Distinct advantages are offered by the selective hydrotreating apparatus and processes described herein when compared to conventional processes for deep desulfurization of hydrocarbon fuel. For example, in certain conventional approaches to deep desulfurization, the entire hydrocarbon stream undergoes a single hydrotreating step, requiring unit operations of a capacity suitable for the full feedstream and operating under conditions effective to treat at least a portion of the refractory compounds. Furthermore, the high operating costs and undesired side reactions that can negatively impact certain desired fuel characteristics are avoided using the selective hydrotreating apparatus and processes described herein. In addition, in certain embodiments aromatic compounds without heteroatoms (e.g., one or more ring containing aromatics such as benzene, naphthalene, and their derivatives) are passed to the aromatic-rich fraction and are hydrogenated and hydrocracked in the second, relatively more severe, hydrotreating zone to produce light distillates. The yield of these light distillates that meet the product specification derived from the aromatic compounds without heteroatoms is greater than the yield in conventional hydrocracking operations due to the focused and targeted hydrotreating zones.

As the herein described examples demonstrate, by separating a feedstock into an aromatic-rich fraction and an aromatic-lean fraction, and treating the aromatic-rich fraction containing refractory sulfur compounds under relatively severe hydrodesulfurization conditions, the hydrotreating unit processing aromatic-lean portion can be operated under relatively mild operating conditions. If the same stream is to be treated in a single hydrotreating unit, one or more of the hydrogen partial pressure, operating pressure, operating temperature and/or catalyst volume must be increased to achieve desulfurization levels as shown herein.

The initial feedstock for use in above-described apparatus and process can be a crude or partially refined oil product obtained from various sources. The source of feedstock can be crude oil, synthetic crude oil, bitumen, oil sand, shale oil, coal liquids, or a combination including one of the foregoing sources. For example, the feedstock can be a straight run gas oil or other refinery intermediate stream such as vacuum gas oil, deasphalted oil and/or demetalized oil obtained from a solvent deasphalting process, light coker or heavy coker gas oil obtained from a coker process, cycle oil obtained from an FCC process, gas oil obtained from a visbreaking process, or any combination of the foregoing products. In certain embodiments, a suitable hydrocarbon feedstock is a straight run gas oil, a middle distillate fraction, or a diesel fraction, boiling in the range of from about 180° C. to about 450° C., in certain embodiments about 180° C. to about 400° C., and in further embodiments about 180° C. to about 370° C., typically containing up to about 2 W % sulfur and up to about 3,000 ppmw nitrogen. Nonetheless, one of ordinary skill in the art will appreciate that other hydrocarbon streams can benefit from the practice of the system and method described herein.

The first hydrotreating zone utilizes hydrotreating catalyst having one or more active metal components selected from the Periodic Table of the Elements Group VI, VII or VIIIB. In certain embodiments the active metal component is one or more of cobalt, nickel, tungsten and molybdenum, typically deposited or otherwise incorporated on a support, e.g., alumina, silica alumina, silica, or zeolites. In certain embodiments, the hydrotreating catalyst used in the first hydrotreating zone, i.e., operating under mild conditions, includes a combination of cobalt and molybdenum deposited on an alumina substrate.

As used herein, "mild" operating conditions are relative and the range of operating conditions depend on the feedstock being processed. As described above, these conditions are generally an operating temperature of 400° C. and below, a hydrogen partial pressure of 40 bars and below, and a hydrogen feed rate of 500 liters per liter of oil and below. In certain embodiments of the process described herein, these mild operating conditions as used in conjunction with hydrotreating a mid-distillate stream, i.e., boiling in the range of from about 180° C. to about 370° C., include: a temperature in the range of from about 300° C. to about 400° C., and in certain embodiments about 320° C. to about 380° C.; a reaction pressure in the range of from about 10 bars to about 40 bars, in certain embodiments about 20 bars to about 40 bars and in further embodiments about 30 bars; a hydrogen partial pressure greater than about 35 bars in certain embodiments, and up to about 55 bars in other embodiments; a feedstock liquid hourly space velocity (LHSV) in the range of from about 0.5 $h^{-1}$ to about 10 $h^{-1}$, and in certain embodiments about 1.0 $h^{-1}$ to about 4.0 $h^{-1}$; and a hydrogen feed rate in the range of from about 100 standard liters of hydrogen per liter of oil (SLt/Lt) to about 500 SLt/Lt, and in certain embodiments about 100 SLt/Lt to about 300 SLt/Lt.

The second hydrotreating zone utilizes one or more hydrotreating catalysts including active metal(s) from the Periodic Table of the Elements Group VIB, VIIB or VIIIB. In certain embodiments the active metal component is one or more of cobalt, nickel, tungsten and molybdenum, typically deposited or otherwise incorporated on a support, e.g., alumina, silica alumina, silica, or zeolites. In certain embodiments, the hydrotreating catalyst used in the second hydrotreating zone, i.e., under relatively severe conditions, can be nickel and molybdenum deposited on an alumina substrate, nickel, cobalt and molybdenum deposited on an alumina substrate, or either or both of these in combination with cobalt and molybdenum deposited on an alumina substrate.

As used herein, "severe" operating conditions are relative and the range of operating conditions depend on the feedstock being processed. As described above, these conditions are generally an operating temperature of 320° C. and above, a hydrogen partial pressure of 40 bars and above, and a hydrogen feed rate of 300 liters per liter of oil and above. In certain embodiments of the process described herein, these severe operating conditions as used in conjunction with hydrotreating a mid-distillate stream, i.e., boiling in the range of from about 180° C. to about 370° C., include: a temperature in the range of from about 300° C. to about 400° C., and in certain embodiments about 320° C. to about 400° C.; a reaction pressure in the range of from about 20 bars to about 100 bars, and in certain embodiments about 40 bars to about 80 bars; a hydrogen partial pressure of above about 35 bars, and in certain embodiments in the range of from about 35 bars to about 75 bars; an LHSV in the range of from about 0.1 $h^{-1}$ to about 6 $h^{-1}$ and in certain embodiments about 0.5 $h^{-1}$ to about 4.0 $h^{-1}$; and a hydrogen feed rate in the range of from about 100 SLt/Lt to about 1000 SLt/Lt, and in certain embodiments about 300 SLt/Lt to about 800 SLt/Lt.

Suitable aromatic hydrogenation zone apparatus include any suitable reaction apparatus capable of maintaining the desired residence time and operating conditions. In general, the operating conditions for the aromatic hydrogenation zone include: a temperature in the range of from about 250° C. to about 400° C., and in certain embodiments about 280° C. to about 330° C.; a reaction pressure in the range of from about 40 bars to about 100 bars, and in certain embodiments about 60 bars to about 80 bars; a hydrogen partial pressure of above about 35 bars, and in certain embodiments in the range of from about 35 bars to about 75 bars; an LHSV in the range of from about 0.5 $h^{-1}$ to about 10 $h^{-1}$, and in certain embodiments about 0.5 $h^{-1}$ to about 4.0 $h^{-1}$; and a hydrogen feed rate in the range of from about 100 SLt/Lt to about 1000 SLt/Lt, and in certain embodiments about 300 SLt/Lt to about 800 SLt/Lt.

The aromatic hydrogenation zone utilizes one of more aromatic hydrogenation catalyst including active metal(s) from the Periodic Table of the Elements Group VI, VII or VIIIB. In certain embodiments the active metal component is one or more of palladium and platinum metal or metal compound, typically deposited or otherwise incorporated on a support, e.g., alumina, silica, silica alumina, zeolites, titanium oxide, magnesia, boron oxide, zirconia, and clays. The active metals can also be nickel and molybdenum in combination deposited on a suitable support, e.g., alumina. The concentration of metal(s) is in the range of about 0.01 W % to about 10 W % in the catalyst product. In certain embodiments, the hydrogenation zone utilizes hydrotreating catalysts with one or more of platinum and palladium supported on an alumina base.

The aromatic separation apparatus is generally based on selective aromatic extraction. For instance, the aromatic separation apparatus can be a suitable solvent extraction aromatic separation apparatus capable of partitioning the feed into a generally aromatic-lean stream and a generally aromatic-rich stream.

Figure 4:
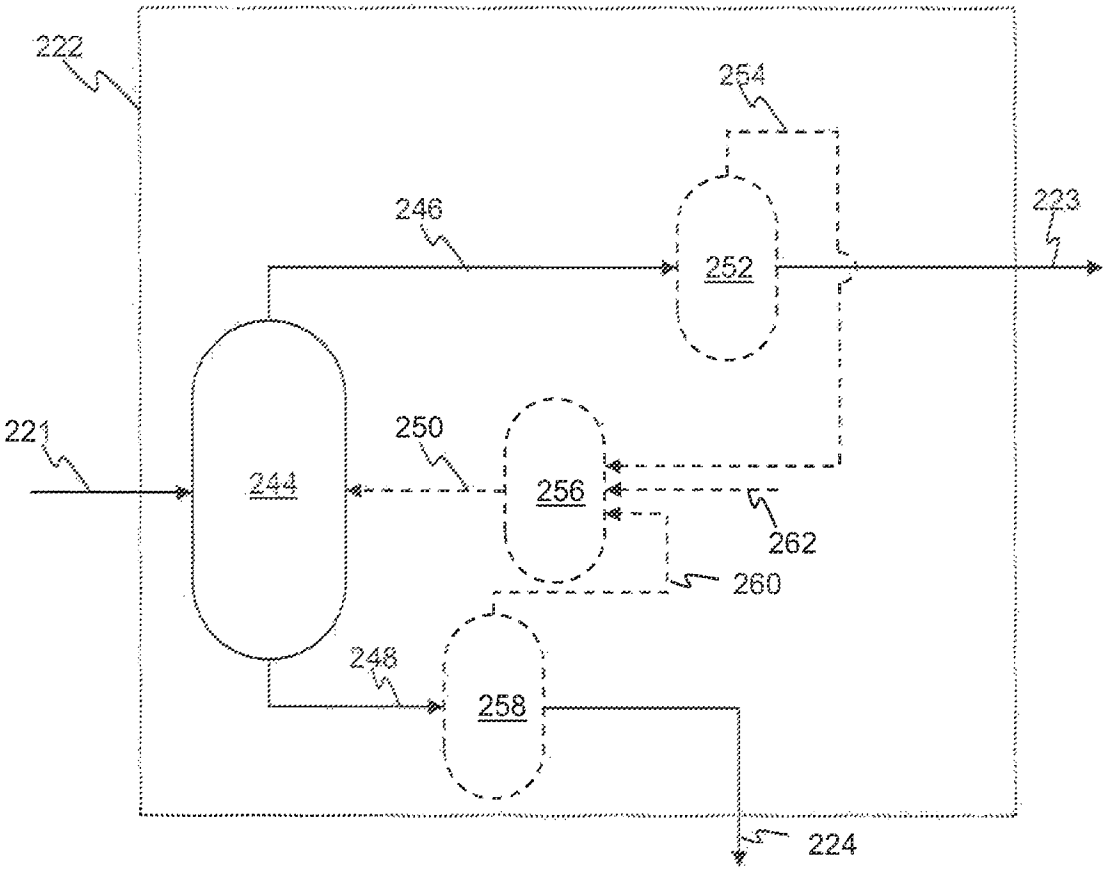
FIG. 4 is a schematic diagram of an aromatic separation zone.

As shown in FIG. 4, an aromatic separation apparatus 222 can include suitable unit operations to perform a solvent extraction of aromatics, and recover solvents for reuse in the process. A feed 221 is conveyed to an aromatic extraction vessel 244 in which a first, aromatic-lean, fraction is separated as a raffinate stream 246 from a second, generally aromatic-rich, fraction as an extract stream 248. A solvent feed 250 is introduced into the aromatic extraction vessel 244.

A portion of the extraction solvent can also exist in stream 246, e.g., in the range of about 0 W % to about 15 W % (based on the total amount of stream 246), and in certain embodiments less than about 8 W %. In operations in which the solvent carried over in stream 246 exceeds a desired or predetermined amount, solvent can be removed from the hydrocarbon product, for example, using a flashing or stripping unit 252, or other suitable apparatus. Solvent stream 254 from the flashing unit 252 can be recycled to the aromatic extraction vessel 244, e.g., via a surge drum 256. Initial solvent feed or make-up solvent can be introduced via stream 262. An aromatic-lean stream 223 is discharged from the flashing unit 252.

In addition, a portion of the extraction solvent can also exist in stream 248, e.g., in the range of about 70 W % to about 98 W % (based on the total amount of stream 250), preferably less than about 85 W %. In embodiments in which solvent present in stream 248 exceeds a desired or predetermined amount, solvent can be removed from the hydrocarbon product, for example as shown in FIG. 4, using a flashing or stripping unit 258 or other suitable apparatus. Solvent 260 from the flashing unit 258 can be recycled to the aromatic extraction vessel 244, e.g., via the surge drum 256. An aromatic-rich stream 224 is discharged from the flashing unit 258.

Selection of solvent, operating conditions, and the mechanism of contacting the solvent and feed permit control over the level of aromatic extraction. For instance, suitable solvents that include furfural, N-methyl-2-pyrrolidone, dimethylformamide and dimethylsulfoxide, can be provided in a solvent-to-oil ratio of about 20:1, in certain embodiments about 4:1, and in further embodiments about 1:1. The aromatic separation apparatus can operate at a temperature in the range of about 20° C. to about 120° C., and in certain embodiments in the range of about 40° C. to about 80° C. The operating pressure of the aromatic separation apparatus can be in the range of about 1 bar to about 10 bars, in certain embodiments in the range of about 1 bar to 3 bars. Types of apparatus useful as the aromatic separation apparatus in certain embodiments of the system and process described herein include stage-type extractors or differential extractors.

Figure 5:
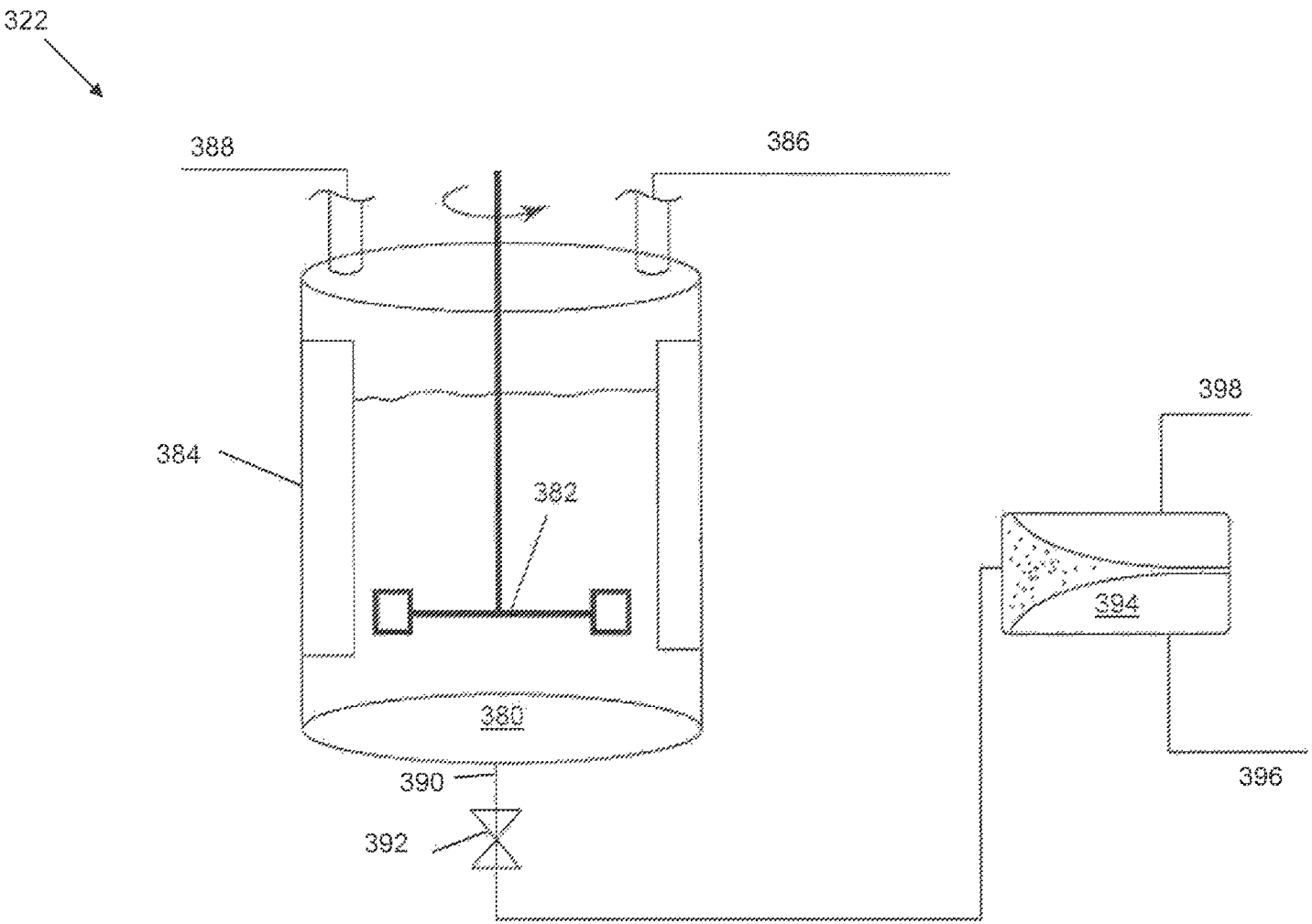
FIGS. 5-10 are schematic diagrams of exemplary apparatus suitable for use as the aromatic extraction zone.

An example of a stage-type extractor is a mixer-settler apparatus 322 schematically illustrated in FIG. 5. Mixer-settler apparatus 322 includes a vertical tank 380 incorporating a turbine or a propeller agitator 382 and one or more baffles 384. Charging inlets 386, 388 are located at the top of tank 380 and outlet 390 is located at the bottom of tank 380. The feedstock to be extracted is charged into vessel 380 via inlet 386 and a suitable quantity of solvent is added via inlet 388. The agitator 382 is activated for a period of time sufficient to cause intimate mixing of the solvent and charge stock, and at the conclusion of a mixing cycle, agitation is halted and, by control of a valve 392, at least a portion of the contents are discharged and passed to a settler 394. The phases separate in the settler 394 and a raffinate phase containing an aromatic-lean hydrocarbon mixture and an extract phase containing an aromatic-rich mixture are withdrawn via outlets 396 and 398, respectively. In general, a mixer-settler apparatus can be used in batch mode, or a plurality of mixer-settler apparatus can be staged to operate in a continuous mode.

Another stage-type extractor is a centrifugal contactor. Centrifugal contactors are high-speed, rotary machines characterized by relatively low residence time. The number of stages in a centrifugal device is usually one; however, centrifugal contactors with multiple stages can also be used. Centrifugal contactors utilize mechanical devices to agitate the mixture to increase the interfacial area and decrease the mass transfer resistance.

Various types of differential extractors (also known as "continuous contact extractors,") that are also suitable for use as an aromatic extraction apparatus in zone 22 include, but are not limited to, centrifugal contactors and contacting columns such as tray columns, spray columns, packed towers, rotating disc contactors and pulse columns.

Contacting columns are suitable for various liquid-liquid extraction operations. Packing, trays, spray or other droplet-formation mechanisms or other apparatus are used to increase the surface area in which the two liquid phases (i.e., a solvent phase and a hydrocarbon phase) contact, which also increases the effective length of the flow path. In column extractors, the phase with the lower viscosity is typically selected as the continuous phase, which, in the case of an aromatic extraction apparatus, is the solvent phase. In certain embodiments, the phase with the higher flow rate can be dispersed to create more interfacial area and turbulence. This is accomplished by selecting an appropriate material of construction with the desired wetting characteristics. In general, aqueous phases wet metal surfaces and organic phases wet non-metallic surfaces. Changes in flows and physical properties along the length of an extractor can also be considered in selecting the type of extractor and/or the specific configuration, materials or construction, and packing material type and characteristics, e.g., average particle size, shape, density, surface area, and the like.

Figure 6:
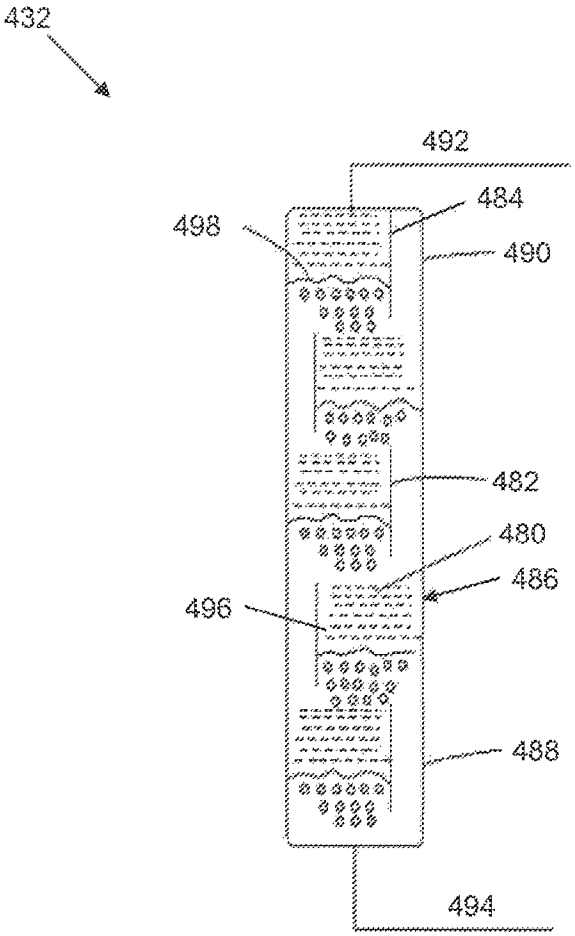

A tray column 422 is schematically illustrated in FIG. 6. A light liquid inlet 488 at the bottom of column 422 receives liquid hydrocarbon, and a heavy liquid inlet 490 at the top of column 422 receives liquid solvent. Column 422 includes a plurality of trays 480 and associated downcomers 482. A top level baffle 484 physically separates incoming solvent from the liquid hydrocarbon that has been subjected to prior extraction stages in the column 422. Tray column 422 is a multi-stage counter-current contactor. Axial mixing of the continuous solvent phase occurs at region 486 between trays 480, and dispersion occurs at each tray 480 resulting in effective mass transfer of solute into the solvent phase. Trays 480 can be sieve plates having perforations ranging from about 1.5 to 4.5 mm in diameter and can be spaced apart about 150-600 mm.

Light hydrocarbon liquid passes through the perforations in each tray 480 and emerges in the form of fine droplets. The fine hydrocarbon droplets rise through the continuous solvent phase and coalesce into an interface layer 496 and are again dispersed through the tray 480 above. Solvent passes across each plate and flows downward from tray 480 above to the tray 480 below via downcomer 482. The principal interface 498 is maintained at the top of column 422. Aromatic-lean hydrocarbon liquid is removed from outlet 492 at the top of column 422 and aromatic-rich solvent liquid is discharged through outlet 494 at the bottom of column 422. Tray columns are efficient solvent transfer apparatus and have desirable liquid handling capacity and extraction efficiency, particularly for systems of low-interfacial tension.

Figure 7:
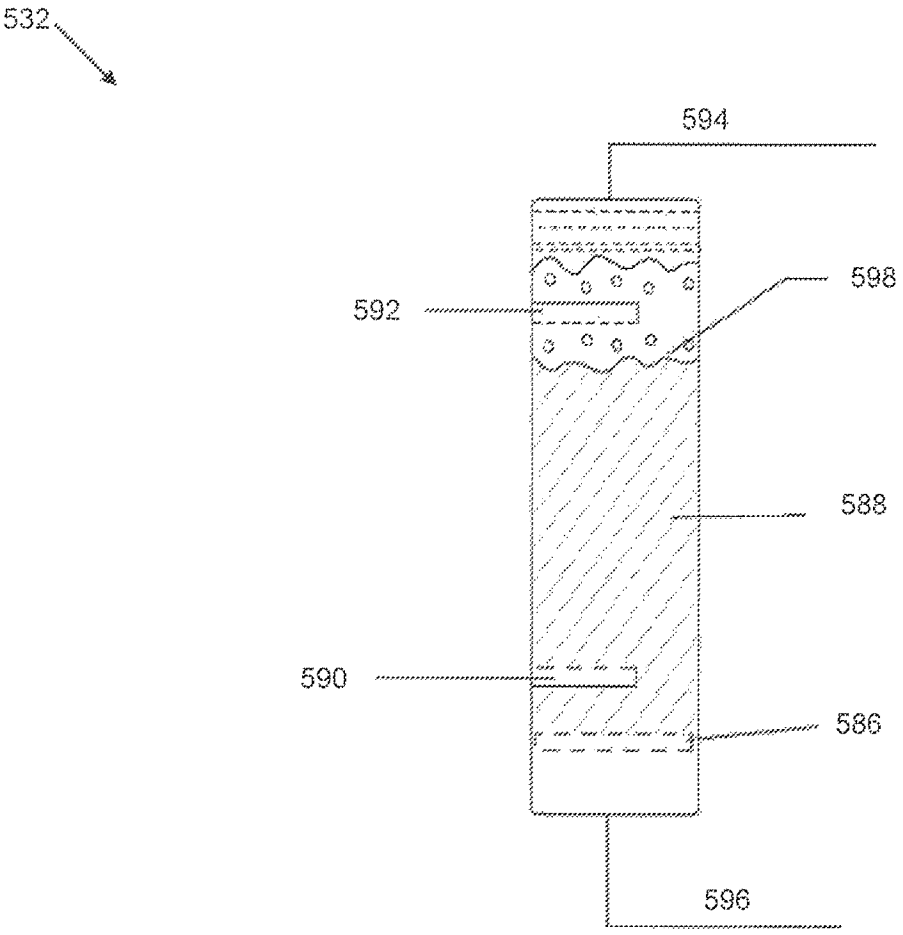

An additional type of unit operation suitable for extracting aromatics from the hydrocarbon feed is a packed bed column. FIG. 7 is a schematic illustration of a packed bed column 522 having a hydrocarbon inlet 590 and a solvent inlet 592. A packing region 588 is provided upon a support plate 586. Packing region 588 comprises suitable packing material including, but not limited to, Pall rings, Raschig rings, Kascade rings, Intalox saddles, Berl saddles, super Intalox saddles, super Berl saddles, Demister pads, mist eliminators, telerrettes, carbon graphite random packing, other types of saddles, and the like, including combinations of one or more of these packing materials. The packing material is selected so that it is fully wetted by the continuous solvent phase. The solvent introduced via inlet 592 at a level above the top of the packing region 588 flows downward and wets the packing material and fills a large portion of void space in the packing region 588. Remaining void space is filled with droplets of the hydrocarbon liquid which rise through the continuous solvent phase and coalesce to form the liquid-liquid interface 598 at the top of the packed bed column 522. Aromatic-lean hydrocarbon liquid is removed from outlet 594 at the top of column 522 and aromatic-rich solvent liquid is discharged through outlet 596 at the bottom of column 522. Packing material provides large interfacial areas for phase contacting, causing the droplets to coalesce and reform. The mass transfer rate in packed towers can be relatively high because the packing material lowers the recirculation of the continuous phase.

Figure 8:
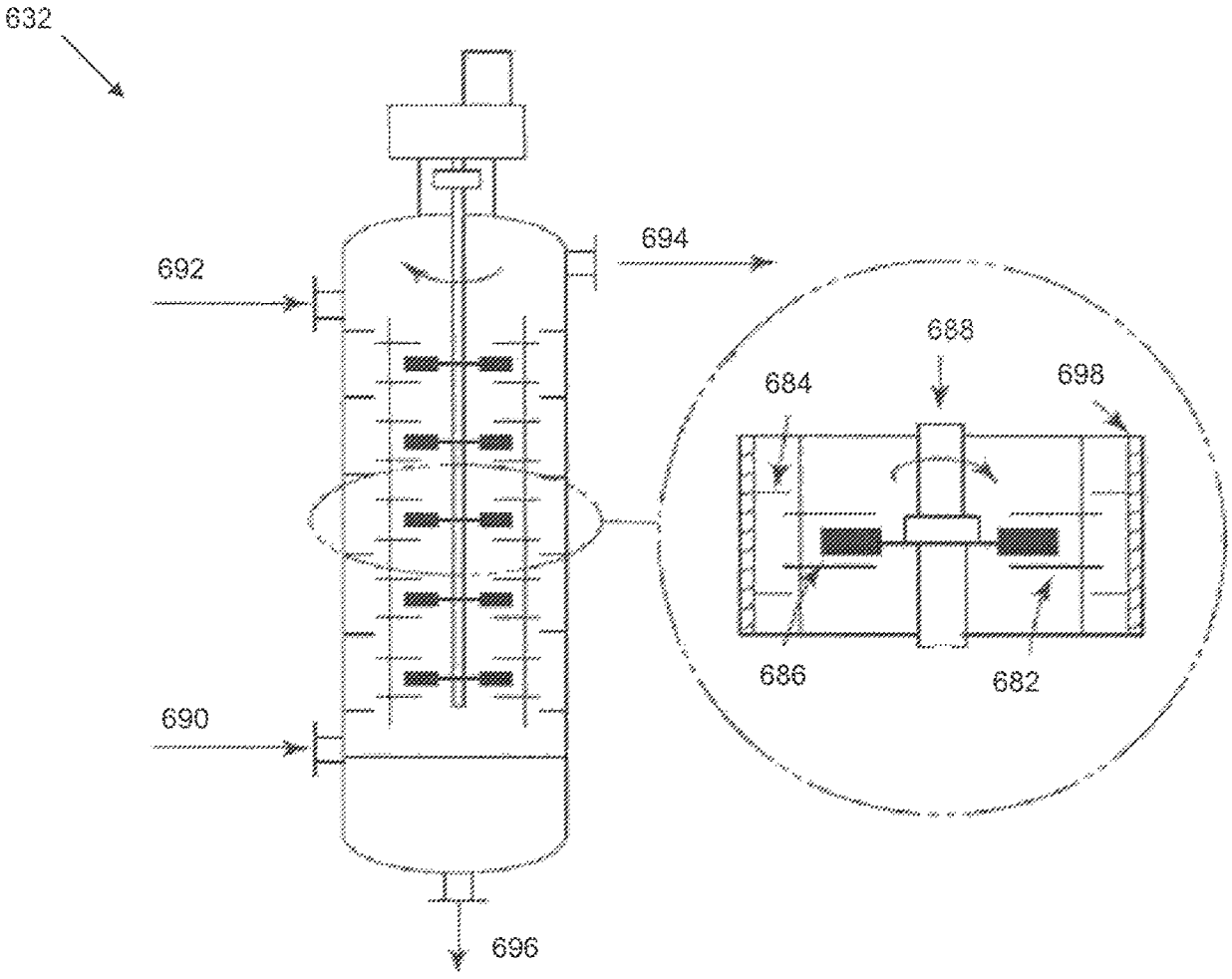

Further types of apparatus suitable for aromatic extraction in the system and method herein include rotating disc contactors. FIG. 8 is a schematic illustration of a rotating disc contactor 622 known as a Scheiebel® column commercially available from Koch Modular Process Systems, LLC of Paramus, N.J., USA. It will be appreciated by those of ordinary skill in the art that other types of rotating disc contactors can be implemented as an aromatic extraction unit included in the system and method herein, including but not limited to Oldshue-Rushton columns, and Kuhni extractors. The rotating disc contactor is a mechanically agitated, counter-current extractor. Agitation is provided by a rotating disc mechanism, which typically runs at much higher speeds than a turbine type impeller as described with respect to FIG. 5.

Rotating disc contactor 622 includes a hydrocarbon inlet 690 toward the bottom of the column and a solvent inlet 692 proximate the top of the column, and is divided into number of compartments formed by a series of inner stator rings 682 and outer stator rings 684. Each compartment contains a centrally located, horizontal rotor disc 686 connected to a rotating shaft 688 that creates a high degree of turbulence inside the column. The diameter of the rotor disc 686 is slightly less than the opening in the inner stator rings 682. Typically, the disc diameter is 33-66% of the column diameter. The disc disperses the liquid and forces it outward toward the vessel wall 698 where the outer stator rings 684 create quiet zones where the two phases can separate. Aromatic-lean hydrocarbon liquid is removed from outlet 694 at the top of column 622 and aromatic-rich solvent liquid is discharged through outlet 696 at the bottom of column 622. Rotating disc contactors advantageously provide relatively high efficiency and capacity and have relatively low operating costs.

Figure 9:
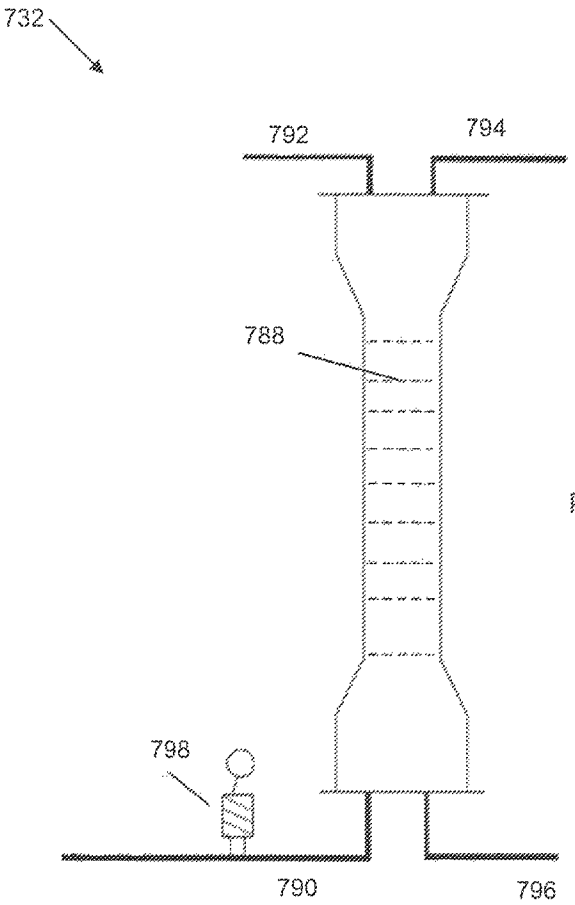

An additional type of apparatus suitable for aromatic extraction in the system and method herein is a pulse column. FIG. 9 is a schematic illustration of a pulse column system 722, which includes a column with a plurality of packing or sieve plates 788, a light phase, i.e., solvent, inlet 790, a heavy phase, i.e., hydrocarbon feed, inlet 792, a light phase outlet 794 and a heavy phase outlet 796.

In general, pulse column system 722 is a vertical column with a large number of sieve plates 788 lacking down comers. The perforations in the sieve plates 788 typically are smaller than those of non-pulsating columns, e.g., about 1.5 mm to about 3.0 mm in diameter.

A pulse-producing device 798, such as a reciprocating pump, pulses the contents of the column at frequent intervals. The rapid reciprocating motion, of relatively small amplitude, is superimposed on the usual flow of the liquid phases. Bellows or diaphragms formed of coated steel (e.g., coated with polytetrafluoroethylene), or any other reciprocating, pulsating mechanism can be used. A pulse amplitude of 5-25 mm is generally recommended with a frequency of 100-260 cycles per minute. The pulsation causes the light liquid (solvent) to be dispersed into the heavy phase (oil) on the upward stroke and heavy liquid phase to jet into the light phase on the downward stroke. The column has no moving parts, low axial mixing, and high extraction efficiency.

Figure 10:
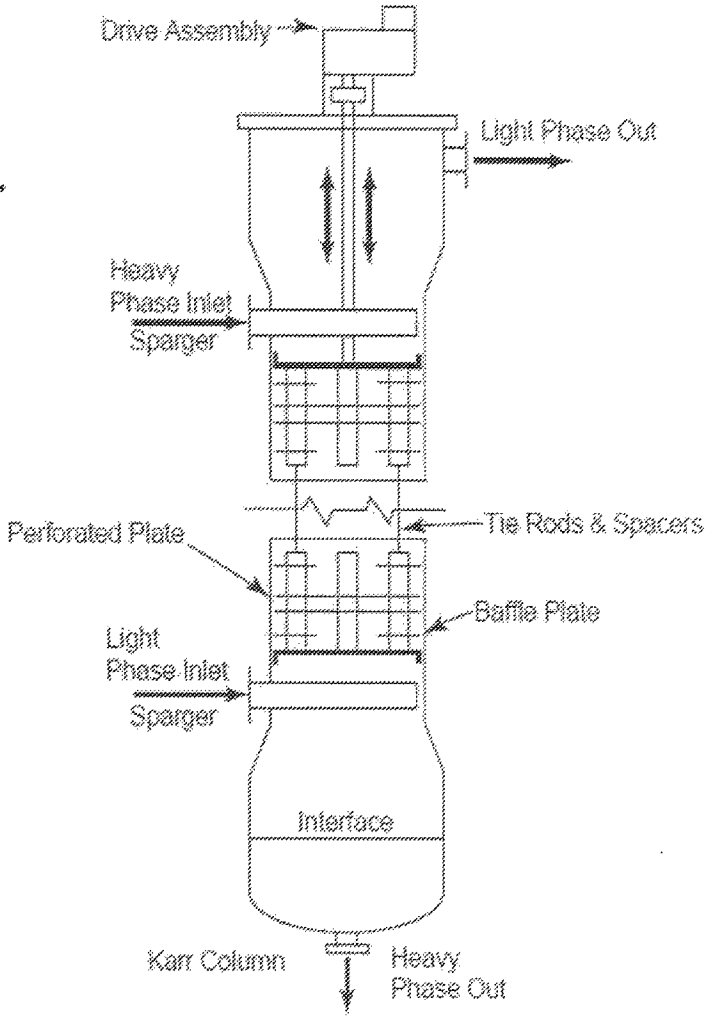

A pulse column typically requires less than a third of the number of theoretical stages as compared to a non-pulsating column. A specific type of reciprocating mechanism is used in a Karr Column which is shown in FIG. 10.

EXAMPLES

Example 1

A gas oil stream boiling in the range of from 180° C.-370° C., the properties of which are given in Table 1, was hydrodesulfurized in a single hydrotreating reactor. To achieve 10 ppmw sulfur diesel oil, the hydrotreater was operated at 350° C., a liquid hourly space velocity of 1.5 $h^{-1}$ and hydrogen partial pressure of 30 $kg/cm^2$.

TABLE 1

| Property | Unit | Value |
|---|---|---|
| Specific Gravity | | 0.8262 |
| Sulfur | W % | 1 |
| Nitrogen | ppmw | 63 |
| ASTM D 2887 | ° C. | |
| IBP | ° C. | 84 |
| 5 | ° C. | 136 |
| 10 | ° C. | 162 |
| 30 | ° C. | 219 |
| 50 | ° C. | 267 |
| 70 | ° C. | 309 |
| 90 | ° C. | 351 |
| 95 | ° C. | 362 |
| FBP | ° C. | 375 |

Example 2

The same gas oil was fractionated into two fractions, an aromatic-rich fraction and an aromatic-lean fraction. The sulfur content and yields of these fractions are given in Table 2. It can be seen that only 31 W % of aromatics are present in the gas oil stream. The remaining 69 W % is the aromatic-lean fraction, i.e., rich in paraffins and naphthenes.

TABLE 2

| | Fraction | |
|---|---|---|
| Property | Aromatic-Rich | Aromatic-Lean |
| Yields, W % | 31 | 69 |
| Sulfur, W % | 0.88 | 0.12 |

The aromatic-rich and aromatic-lean fractions were hydrotreated in separate reactors to produce 10 ppmw sulfur diesel. Catalyst requirements in both reactors were calculated at the same hydrogen partial pressure of 30 $kg/cm^2$ and operating temperature of 350° C., the catalyst requirement for the severe hydrodesulfurization reaction zone was 70% less than the unfractionated gas oil stream, and the catalyst requirement for the mild hydrodesulfurization reaction zone was 61% less than the unfractionated gas oils stream. Thus, the overall requirements for catalyst and/or reactor volume were reduced by 33%.

Example 3

The same gas oil fractions as in Example 2 were hydrotreated in separated reactors, in which certain operating conditions were maintained at equivalent levels to produce diesel oil containing 10 ppmw of sulfur. Hydrogen partial pressures in both reactors were calculated at the operating conditions of a temperature of 350° C., a liquid hourly space velocity of 1.5 $h^{-1}$. The hydrogen partial pressure requirement for the mild hydrodesulfurization reaction zone was 50% less than that for an unfractionated gas oil stream, and the hydrogen partial pressure requirement for the severe hydrodesulfurization reaction zone was 20% more than that for an unfractionated gas oil stream. The overall reduction in hydrogen partial pressures resulted in a relative hydrogen savings of 67 volume %.

The method and system herein have been described above and in the attached drawings; however, modifications will be apparent to those of ordinary skill in the art and the scope of protection for the invention is to be defined by the claims that follow.

We claim:

1. A method of processing a hydrocarbon feed to reduce the concentration of undesired organosulfur compounds, the hydrocarbon feed selected from the group of feeds consisting of vacuum gas oil, deasphalted oil or demetalized oil obtained from a solvent deasphalting process, light coker or heavy coker gas oil obtained from a coker process, cycle oil obtained from an FCC process, gas oil obtained from a visbreaking process, straight run gas oil, a middle distillate fraction, a diesel fraction, and a combination comprising at least one of the foregoing feeds, the method comprising:

separating the hydrocarbon feed into an aromatic-lean fraction that contains labile heteroatom-containing compounds and an aromatic-rich fraction that contains refractory aromatic heteroatom-containing compounds;

introducing the aromatic-lean fraction to a first hydrotreating zone operating at mild hydrotreating conditions effective for reducing the sulfur content of the aromatic-lean fraction including hydrogen partial pressures of about 30 bars and below and recovering a first hydrotreated effluent;

introducing the aromatic-rich fraction to a second hydrotreating zone operating at conditions effective for reducing the sulfur content of the aromatic-rich fraction including hydrogen partial pressures of about 40 bars and above, and recovering a second hydrotreated effluent;

removing light gases from the second hydrotreated effluent to produce a hydrotreated liquid effluent; and introducing the hydrotreated liquid effluent to an aromatic hydrogenation zone and recovering a hydrogenated hydrocarbon product stream.

2. The method of claim 1, wherein separating the hydrocarbon feed into an aromatic-lean fraction and an aromatic-rich fraction comprises:

subjecting the hydrocarbon feed and an effective quantity of an extraction solvent to an extraction zone to produce an extract containing a major proportion of the aromatic content of the hydrocarbon feed and a portion of the extraction solvent and a raffinate containing a major proportion of the non-aromatic content of the hydrocarbon feed and a portion of the extraction solvent;

separating at a least substantial proportion of the extraction solvent from the raffinate and retaining the aromatic-lean fraction; and separating at least a substantial portion of the extraction solvent from the extract and retaining the aromatic-rich fraction.

3. The method of claim 1, wherein the aromatic-rich fraction includes benzothiophene, alkylated derivatives of benzothiophene, dibenzothiophene, alkyl derivatives of dibenzothiophene, benzonaphtenothiophene, and alkyl derivatives of benzonaphtenothiophene.

4. The method of claim 1, wherein the aromatic-rich fraction includes aromatic nitrogen compounds including pyrrole, quinoline, acridine, carbazole and their derivatives.

5. The method of claim 1, wherein the hydrocarbon feed has boiling point in the range of from about 180° C. to about 450° C.

6. The method of claim 1, wherein the operating temperature in the first hydrotreating zone is in the range of from about 300° C. to about 400° C.

7. The method of claim 1, wherein the hydrogen feed rate in the first hydrotreating zone is in the range of from about 100 standard liters of hydrogen per liter of oil to about 500 standard liters of hydrogen per liter of oil.

8. The method of claim 1, wherein the feedstock liquid hourly space velocity in the first hydrotreating zone is in the range of from about 0.5 $hr^{-1}$ to about 10 $hr^{-1}$.

9. The method of claim 1, wherein the operating temperature in the second hydrotreating zone is in the range of from about 300° C. to about 400° C.

10. The method of claim 1, wherein the hydrogen feed rate in the second hydrotreating zone is in the range of from about 100 SLt/Lt to about 1000 SLt/Lt.

11. The method of claim 1, wherein the pressure in the second hydrotreating zone is from about 40 bars to about 100 bars.

12. The method of claim 1, wherein the liquid hourly space velocity in the second hydrotreating zone is in the range of from about 0.1 $h^{-1}$ to about 6.0 $h^{-1}$.

13. The method of claim 1, wherein the hydrotreating catalyst in the second hydrotreating zone includes nickel and molybdenum deposited on an alumina substrate.

14. The method of claim 1, wherein the hydrotreating catalyst in the second hydrotreating zone includes nickel, cobalt and molybdenum deposited on an alumina substrate.

15. The method of claim 1, wherein the hydrotreating catalyst in the second hydrotreating zone includes a combination of cobalt and molybdenum deposited on an alumina substrate and nickel and molybdenum deposited on an alumina substrate.

16. The method of claim 2, wherein the extraction zone is a stage-type extractor.

17. The method of claim 2, wherein the extraction zone is a differential extractor.

18. The method of claim 1, wherein the hydrogen partial pressure in the aromatic hydrogenation zone is in the range of from about 40 bars to about 100 bars.

19. The method of claim 1, wherein the operating temperature in the aromatic hydrogenation zone is in the range of from about 250° C. to about 400° C.

20. The method of claim 1, wherein the hydrogen feed rate in the aromatic hydrogenation zone is in the range of from about 100 SLt/Lt to about 1000 SLt/Lt.

21. The method of claim 1, wherein the liquid hourly space velocity in the aromatic hydrogenation zone is in the range of from about 0.5 $h^{-1}$ to about 10 $h^{-1}$.

22. The method of claim 1, wherein the catalyst in the aromatic hydrogenation zone includes platinum, palladium or a combination of platinum and palladium.

23. The method of claim 1 in which at least one of the first and second hydrotreating zones comprise a layered catalyst bed containing at least a first and second layer of different catalyst compositions, and the catalysts are Co—Mo on alumina and Ni—Mo on alumina.

24. The method of claim 1 in which the aromatic-lean fraction contacts a Co—Mo catalyst composition in the first hydrotreating zone.

25. The method of claim 1 in which the aromatic-rich fraction contacts a Co—Mo—Ni catalyst composition in the second hydrotreating zone.

26. The method of claim 1 in which the feedstream also contains nitrogen and the aromatic-rich fraction contacts Ni—Mo catalyst composition in the second hydrotreating zone.

27. A method of processing a hydrocarbon feed selected from straight run gas oil, a middle distillate fraction, or a diesel fraction, to reduce the concentration of undesired organosulfur compounds comprising:

separating the hydrocarbon feed into an aromatic-lean fraction that contains labile heteroatom-containing compounds and an aromatic-rich fraction that contains refractory aromatic heteroatom-containing compounds, wherein separating the hydrocarbon feed into the aromatic-lean fraction and the aromatic-rich fraction is by contacting the hydrocarbon feed and an effective quantity of extraction solvent to an extraction zone to produce an extract containing a major proportion of the aromatic content of the hydrocarbon feed and a portion of the extraction solvent and a raffinate containing a major proportion of the non-aromatic content of the hydrocarbon feed and a portion of the extraction solvent, separating at least substantial portion of the extraction solvent from the raffinate and recovering the aromatic-lean fraction, and separating at least substantial portion of the extraction solvent from the extract and recovering the aromatic-rich fraction, wherein the extraction solvent is selected from the group consisting of furfural, N-methyl-2-pyrrolidone, dimethylformamide and dimethylsulfoxide;

introducing the aromatic-lean fraction to a first hydrotreating zone operating at mild hydrotreating conditions effective for reducing the sulfur content of the aromatic-lean fraction including hydrogen partial pressures of about 30 bars and below and recovering a first hydrotreated effluent;

introducing the aromatic-rich fraction to a second hydrotreating zone operating at conditions effective for reducing the sulfur content of the aromatic-rich fraction including hydrogen partial pressures of about 40 bars and above and recovering a second hydrotreated effluent;

removing light gases from the second hydrotreated effluent to produce a hydrotreated liquid effluent; and introducing the hydrotreated liquid effluent to an aromatic hydrogenation zone and recovering a hydrogenated hydrocarbon product stream, in which at least one of the first and second hydrotreating zones comprise a layered catalyst bed containing at least a first and second layer of different catalyst compositions, and the catalysts are Co—Mo on alumina and Ni—Mo on alumina.

28. The method of claim 27, wherein the operating temperature in the first hydrotreating zone is in the range of from about 300° C. to about 400° C., the hydrogen feed rate in the first hydrotreating zone is in the range of from about 100 standard liters of hydrogen per liter of oil to about 500 standard liters of hydrogen per liter of oil, and the feedstock liquid hourly space velocity in the first hydrotreating zone is in the range of from about 0.5 $hr^{-1}$ to about 10 $hr^{-1}$.

29. The method of claim 27, wherein the operating temperature in the second hydrotreating zone is in the range of from about 300° C. to about 400° C., the hydrogen feed rate in the second hydrotreating zone is in the range of from about 100 SLt/Lt to about 1000 SLt/Lt, and the pressure in the second hydrotreating zone is from about 40 bars to about 100 bars.

30. The method of claim 27, wherein the hydrogen partial pressure in the aromatic hydrogenation zone is in the range of from about 40 bars to about 100 bars, the operating temperature in the aromatic hydrogenation zone is in the range of from about 250° C. to about 400° C., the hydrogen feed rate in the aromatic hydrogenation zone is in the range of from about 100 SLt/Lt to about 1000 SLt/Lt, the liquid hourly space velocity in the aromatic hydrogenation zone is in the range of from about 0.5 $h^{-1}$ to about 10 $h^{-1}$, and the catalyst in the aromatic hydrogenation zone includes platinum, palladium or a combination of platinum and palladium.

* * * * *